US005743725A

United States Patent [19]

Chan

[11] Patent Number: 5,743,725

[45] Date of Patent: Apr. 28, 1998

[54] SAFETY LIGHTER

[75] Inventor: Leung Chan, Shatin, Hong Kong

[73] Assignee: Cli-Claque Company Limited, Fo Tan, Hong Kong

[21] Appl. No.: 759,022

[22] Filed: Dec. 2, 1996

[51] Int. Cl.[6] ..... F23D 11/36

[52] U.S. Cl. ..... 431/153; 431/276; 431/277

[58] Field of Search ..... 431/153, 276, 431/277

[56] References Cited

U.S. PATENT DOCUMENTS 5,460,516 10/1995 Sher ..... 431/153

5,490,773 2/1996 Capilla ..... 431/277

*Primary Examiner*—Carroll B. Dority

*Attorney, Agent, or Firm*—Wolf, Greenfield & Sacks, P.C.

[57] ABSTRACT

A child resistant safety lighter is provided which includes a detent on the spark wheel of the lighter which inhibits rotation of the spark wheel in its operative direction when the spark wheel is in a first locked or inoperative position. The spark wheel must be rotated in its inoperative direction (i.e., direction opposite its operative direction) by a selected number of degrees, which number of degrees is preferably defined by a second detent on the spark wheel which interacts with the flint to define a second cocked or operative position for the spark wheel. The spark wheel may then be rotated in its operative direction from the second position to the first position to operate the lighter and to also return the lighter to its locked position.

7 Claims, 2 Drawing Sheets

SAFETY LIGHTER

FIELD OF THE INVENTION

This invention relates to lighters such as those used to light cigarettes and more particularly to such a lighter which is resistant to operation by young children and others not competent to handle a lighter.

BACKGROUND OF THE INVENTION

Lighters such as those used by smokers are found extensively in homes and other places occupied by children and others not mentally physically and/or competent to handle such potentially dangerous instruments. However, most such lighters are designed to be easily operated by adults and are therefore also easily operated by children and others not competent to do so. The result is significant of personal injury and property damage each year which could be prevented if the lighters were not so easily operated. However, while efforts have been made in the past to provide safety lighters resistant to operation by children and the like, the increased difficulty of operation by adults has significantly limited their acceptance. Some of these lighters have also been significantly more expensive to manufacture, further limiting their acceptance.

A need therefore exists for an inexpensive lighter which is easily operated by adults while still being significantly resistant to use by children and the like.

SUMMARY OF THE INVENTION

In accordance with the above, this invention provides a lighter which has a flint, a spark wheel rotatable in a first direction to frictionally engage the flint, thereby producing a spark, a reservoir storing a lighter fluid and a valve for releasing a quantity of lighter fluid to be ignited by the spark in conjunction with the rotation in the first direction of the spark wheel. Further, the lighter has a safety mechanism which co-acts with the flint to limit rotation of the spark wheel in the first direction. More specifically, a first detent or slot is formed at a first selected position on the spark wheel, the first detent bearing against the flint to prevent rotation of the spark wheel in the first direction beyond such first position. Therefore, the spark wheel may only be rotated in a second direction opposite the first direction when the first position on the spark wheel is adjacent the flint. A second detent is preferably provided at a second selected position on the spark wheel, the second detent bearing against the flint to prevent further rotation of the spark wheel in the second direction when a second selected position of the spark wheel is adjacent to flint. The angular spacing on the spark wheel in the second direction between the first and second selected positions is preferably greater than 180 degrees. The second detent is preferably also a slot formed in the spark wheel. For preferred embodiments, the spark wheel is attached to a side wheel which side wheel is in turn operated by the user.

The foregoing and another objects, features and advantages of the invention will be apparent from the following more particular description of a preferred embodiment of the invention as illustrated in the accompanying drawings.

DETAILED DESCRIPTION

Figure 1:
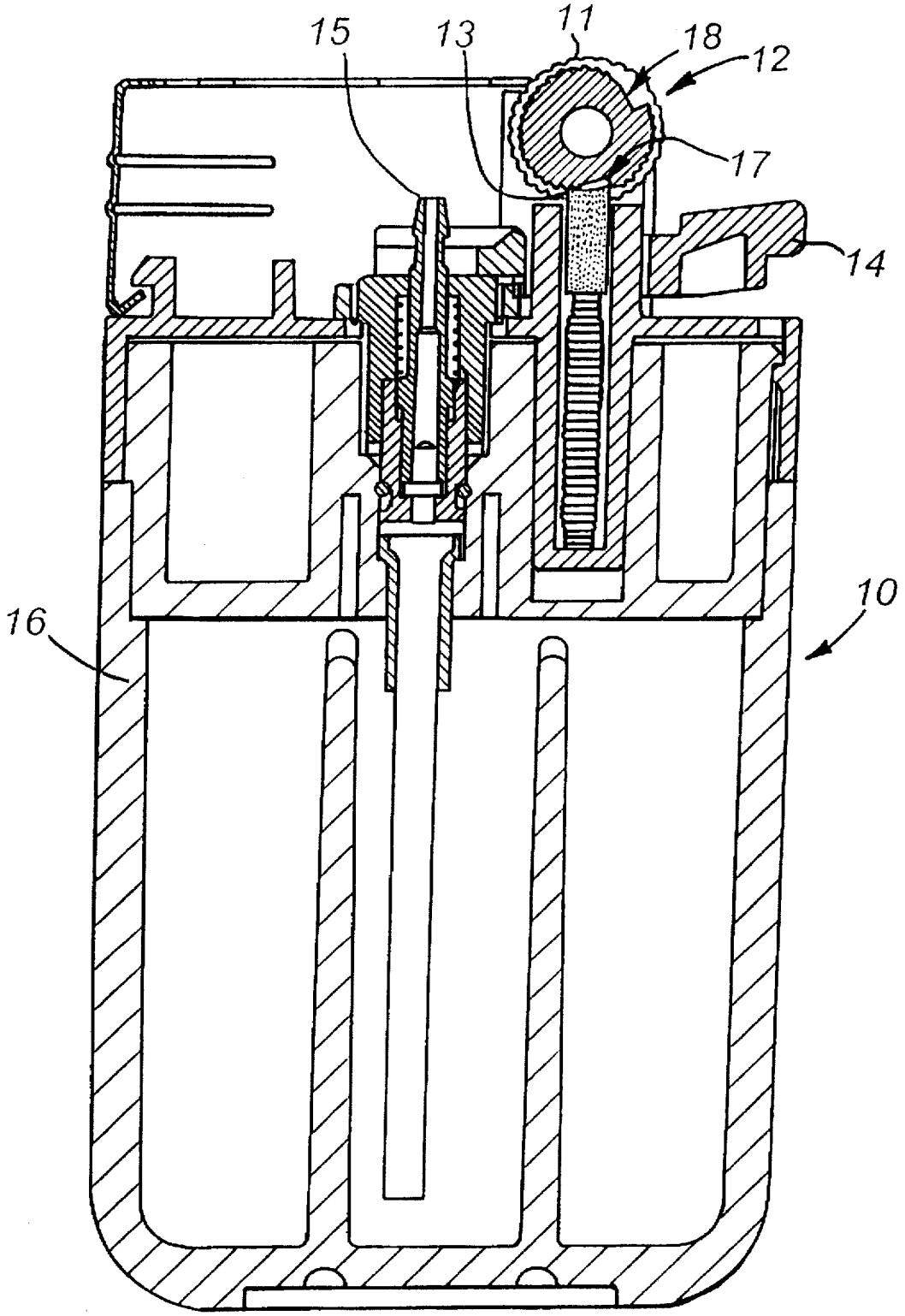
FIG. 1 is a front sectional view of a lighter in accordance with teachings of this invention.

Referring to the figures, the lighter 10 has a side wheel 11 which is adapted to be rotated by a users thumb or other finger. A spark wheel 12 is connected to rotate with side wheel 11. Spark wheel 12 overlies flint 13 and, as will be discussed in greater detail later, has a toothed edge which rubs against flint 13 to cause a spark. The finger rotating side wheel 11 also operates press lever 14 to lift or open nozzle 15, thereby releasing gas from tank 16. The gas in tank 16 may be butane or other gas fluid commonly used in cigarette lighters. As is common in the industry, the spark emitted from flint 3 will ignite the gas from nozzle 15 generating the desired flame. The device described to this point is a standard cigarette lighter normally of the disposable type, and the details of construction of the lighter, for example the operation of nozzle 15, may be the same as that for various prior lighters and do not form part of this invention.

Figure 2:
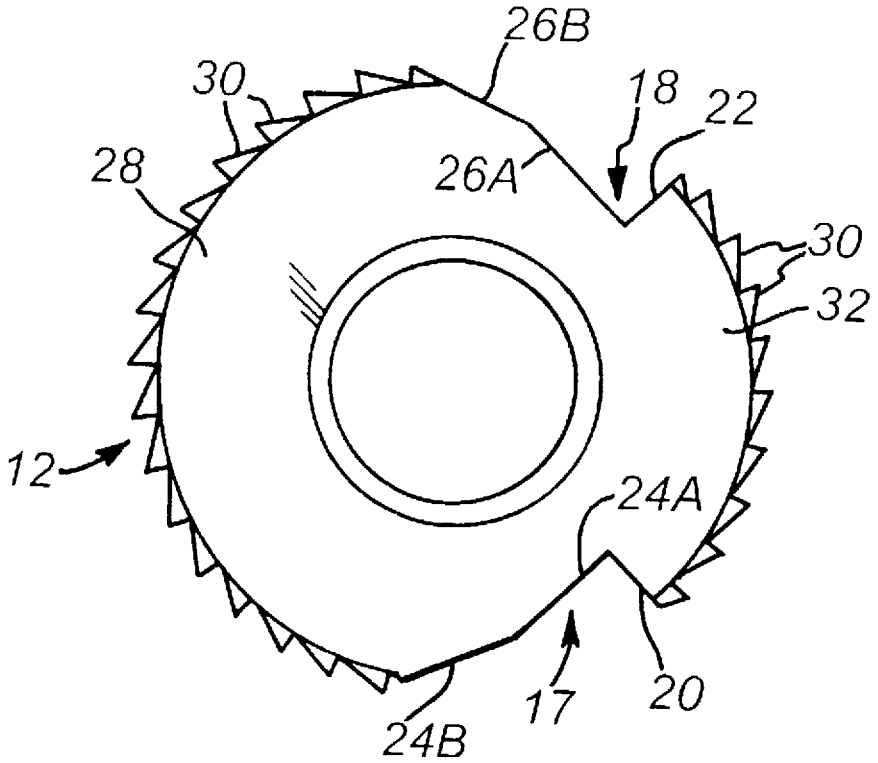
FIG. 2 is an enlarged front view of the spark wheel shown in FIG. 1.

FIG. 2 shows the spark wheel 12 of this invention in greater detail. From FIG. 2 it is seen that the spark wheel has a first slot 17 with a detent wall 20 and a second slot 18 with a detent wall 22. Each slot has a first portion 24A, 26A which is at a substantially right angle to the corresponding detent wall and a second portion 24B, 26B which is at an obtuse angle, for example 158 degrees, to the corresponding first portion. Between slot portions 24B and 26B spark wheel 12 has an operative region 28 with teeth 30. Between walls 20 and 22 spark wheel 12 has a region 32 which also has teeth 30. Region 28 extends for roughly to 180 degrees and each slot 17, 18 extends for approximately 45 degrees.

In operation, the lighter is normally in a locked or inoperative position as shown in FIG. 1 with detent wall 20 of slot 17 bearing against flint 13 to prevent further movement of the spark wheel and of side wheel 11 attached thereto in the clockwise direction. In order to operate the lighter, it is necessary to rotate the side wheel and the spark wheel attached thereto in a counter clockwise direction until detent wall 22 of slot 18 bears against flint 13 preventing further movement of wheel 11 and 12 in the counter clockwise direction. When this occurs, the lighter is cocked and ready to be operated. Wheel 11 and 12 may then be rotated through an angle of approximately 180 degrees, causing teeth 30 in region 28 of the spark wheel to bear against flint 13 and causing the flint to produce a spark. The operation of the lighter terminates with detent wall 20 of slot 17 against flint 13, returning the lighter to its inoperative or safety position.

Thus, coordinated, two-step process is required to operate the lighter, namely a cocking rotation of wheels 11 and 12 in the counter clockwise direction followed by an operational rotation of wheels 11 and 12 in the clockwise direction. While this operation is very simple for an adult, and does not significantly add to the time required to operate the lighter, it is a sequence of operations a child or other person not competent to operate a lighter is unlikely to inadvertently perform, and the likelihood of the lighter being ignited by a child or the like is therefore significantly reduced.

While the invention has been particularly shown described above with reference to a preferred embodiment, it should be understood that the specific configuration shown, and in particular the specific dimensions indicted, are for purposes of illustration only and that various changes in form or detail may be made therein by one skilled in the art without departing from the spirit and scope of the invention which is to be defined only by the appended claims.

What is claimed is:

1. A lighter having a flint, a spark wheel rotatable in a first direction to functionally engage the flint, thereby producing a spark, a reservoir storing an ignitable fluid, and a valve for releasing a quantity of fluid to be ignited by the spark in conjunction with the rotations in the first directions of said spark wheel, characterized by said spark wheel including a safety mechanism coacting with said flint to limit rotations of the spark wheel in said first direction to less than one revolution.

2. A lighter as claimed in claim 1 wherein said safety mechanism includes a first detent at a first selected position on said spark wheel which detent bears against said flint to prevent rotations of said spark wheel in said first direction beyond said first selected position.

3. A lighter as claimed in claim 2 wherein said detent is a slot formed in said spark wheel.

4. A lighter as claimed in claim 2 wherein said spark wheel may be rotated only in a second direction opposite said first direction when in said first selected position.

5. A lighter as claimed in claim 2 and including a second detent at a second selected position on the spark wheel, said second detent bearing against said flint to prevent further rotation of said spark wheel in said second direction when the second selected position on the spark wheel is adjacent the flint.

6. A lighter as claimed in claim 2 wherein the angular spacing in said second direction between said first and second selected positions is greater than 180 degrees.

7. A lighter as claimed in claim 2 wherein said second detent is a slot.

* * * * *